US010434766B2

(12) United States Patent
Van Brocklin

(10) Patent No.: US 10,434,766 B2
(45) Date of Patent: Oct. 8, 2019

(54) BIAS CURRENT CONTROL FOR PRINT NOZZLE AMPLIFIER

(71) Applicant: HEWLETT-PACKARD DEVELOPMENT COMPANY, L.P., Houston, TX (US)

(72) Inventor: Andrew L. Van Brocklin, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/084,115

(22) Filed: Mar. 29, 2016

(65) Prior Publication Data

US 2016/0207308 A1 Jul. 21, 2016

Related U.S. Application Data

(63) Continuation of application No. 14/374,736, filed as application No. PCT/US2012/034925 on Apr. 25, 2012, now abandoned.

(51) Int. Cl.
*B41J 29/38* (2006.01)
*B41J 2/045* (2006.01)

(52) U.S. Cl.
CPC ..... *B41J 2/04541* (2013.01); *B41J 2/04581* (2013.01)

(58) Field of Classification Search
USPC ..... 347/5; 330/253, 259
See application file for complete search history.

(56) References Cited

U.S. PATENT DOCUMENTS 4,237,425 A * 12/1980 Spiegel ..... H03F 1/307 330/263
5,307,024 A * 4/1994 Metz ..... B01J 31/248 330/259
5,399,992 A * 3/1995 Itakura ..... H03F 1/0244 330/253
6,454,377 B1 9/2002 Ishizaki
7,994,847 B1 8/2011 Signoff
8,289,796 B2 * 10/2012 Lee ..... G11C 7/062 365/189.05
2002/0084717 A1 7/2002 Murphy
(Continued)

FOREIGN PATENT DOCUMENTS

JP 2003246060 9/2003
JP 2008229902 10/2008
WO WO-2009147555 A1 12/2009

OTHER PUBLICATIONS

Lopez-Marten, et al. "Low-Voltage Super Class AB CMOS OTA Cells with Very High Slew Rate and Power Efficiency"; http://ieeexplore.ieee.org/xpls/abs_all.jsp?arnumber=1425714; pp. 1068-1077, vol. 40, Issue 5.

*Primary Examiner* — Lam S Nguyen
(74) *Attorney, Agent, or Firm* — HP Inc.—Patent Department

(57) ABSTRACT

An apparatus includes an amplifier to drive a piezo print nozzle in response to a bias current. A bias adjuster includes a plurality of side legs and a plurality of current mirrors. The bias adjuster varies the bias current in the amplifier based on a variable slew rate associated with an input signal of a print command. The bias adjuster is to selectively mitigate power loss and increase slew rate performance of the amplifier.

15 Claims, 6 Drawing Sheets

(56) References Cited

U.S. PATENT DOCUMENTS

| | | | |
|---|---|---|---|
| 2002/0145637 | A1 | 10/2002 | Umeda et al. |
| 2007/0273442 | A1 | 11/2007 | Bajdechi et al. |
| 2009/0244133 | A1 | 10/2009 | Ootsuka |
| 2010/0118078 | A1 | 5/2010 | Oshima et al. |
| 2010/0188452 | A1 | 7/2010 | Oshima |
| 2012/0161866 | A1 | 6/2012 | Hung et al. |

* cited by examiner

BIAS CURRENT CONTROL FOR PRINT NOZZLE AMPLIFIER

RELATED APPLICATIONS

The present invention is a continuation patent application, claiming priority to Ser. No. 14/374,736, filed on 25 Jun. 2014, the entirety of which is incorporated herein by reference.

BACKGROUND

Print heads employ nozzles to dispense ink when commanded by electronic circuits such as operational amplifiers. One style of print head is a piezo head where voltages applied by the amplifiers to the piezo element of the print head cause ink to dispense from the head and associated nozzle. Current commercial piezo heads have drivers that use a cold switch circuit where there is a high power, high voltage operational amplifier that is located separately from the print head area, and connected typically by a single wire to the print head. This wire carries the waveform that all ink dispensing nozzles utilize. Another type of piezo head driver utilizes a per nozzle strategy to drive individual print nozzles, wherein each piezo nozzle is driven from a separate print driver circuit. In such cases, currents such as amplifier bias current and current that is generated due to the slew rate of the amplifier can be considerable since each of the respective currents in each circuit is multiplied by the number of driver circuits required to drive the associated print heads. In some cases, hundreds of print heads may be driven by hundreds of driver circuits, wherein the bias and slew rate currents can contribute to considerable power losses when considered in the aggregate.

DETAILED DESCRIPTION

Figure 1:
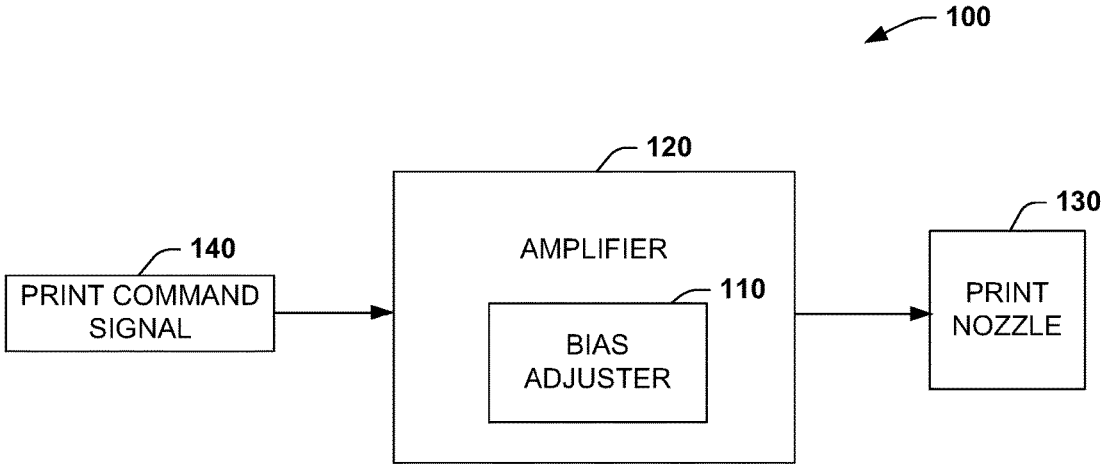
FIG. 1 illustrates an example apparatus that utilizes a bias adjuster and amplifier to drive a print nozzle.

FIG. 1 illustrates an example apparatus 100 that utilizes a bias adjuster 110 and amplifier 120 to drive a print nozzle 130. As shown, a print command signal 140 (e.g., differential voltage signal that commands ink to be dispensed from the print nozzle) can be applied to an input of the amplifier 120 having gain control feedback that amplifies the signal to drive the print nozzle 130. The amplifier 120 can include one or more multiple amplifier stages to drive the print nozzle 130. This can also include a pass gate (not shown) that receives output from the amplifier 120 to drive the print nozzle 120. The bias adjuster 110 varies the bias current in the amplifier 120 as the slew rate of the print command signal 140 varies. As such, higher performance switching operation can be provided in the amplifier 120 while mitigating power losses in the amplifier and in subsequent amplifier stages. As will be described below, one technique for enhancing performance (e.g., lowering transistor impedances, increasing transistor switching times) is by tailoring width and length ratios for the physical dimensions of various switching components in the amplifier 120. By reducing the power in the amplifier and increasing slew rate performance as the print command signal 140 varies, power in the subsequent amplifier stages can be mitigated. In general, the bias current is utilized by the amplifier 120 for normal quiescent operations of the amplifier.

The operational amplifier 120 can be operated in class A-B mode to drive the print nozzle 130. Class A, class A-B, or class B amplifiers can be employed in a single or a multiple stage configuration to generate amplified print command signals to the print nozzle 130. Multiple stage operation can also be provided for the amplifier 120 wherein one stage could be configured as class A, A-B, or class B and a subsequent stage (or subsequent stages) could be configured as class A, A-B or class B, for example. The reduced power savings is further enhanced since there can be hundreds of print nozzles 130—each requiring their own amplifier 120 to command ink dispersal from the respective print nozzles.

In one example, the operational amplifier 120 can be employed as a first stage amplifier to drive a second stage amplifier (illustrated in FIG. 3) that drives the print nozzle 130. In another example, the amplifier 120 can be employed as a first stage amplifier to drive multiple amplifier stages that drive the print nozzle 130. In yet another example, the amplifier 120 can be configured as a multiple stage amplifier having a class AB configuration for one stage and a class B configuration for a second stage. Each stage of the multiple stage amplifiers can have a separate current bias adjuster 110 to mitigate power loss and increase slew rate performance in each stage.

For purposes of simplification of explanation, in the present example, different components of the systems described herein are illustrated and described as performing different functions. However, one of ordinary skill in the art will understand and appreciate that the functions of the described components can be performed by different components, and the functionality of several components can be combined and executed on a single component or be further distributed across more components. The components can be implemented, for example, as an integrated circuit or as discrete components, or as a combination of both. In other examples, the components could be distributed among different printed circuit boards, for example.

Figure 2:
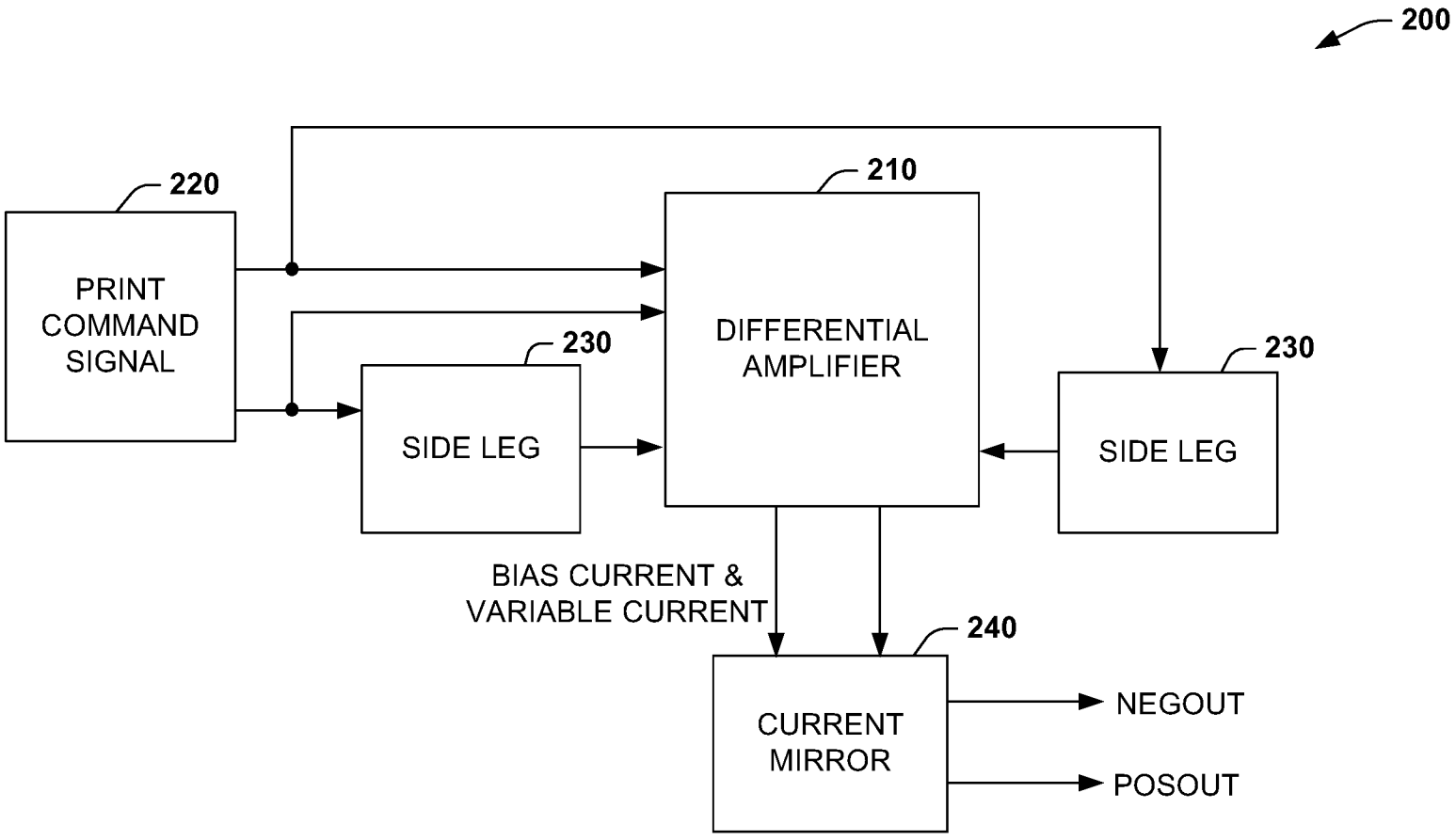
FIG. 2 illustrates an example of an amplifier circuit to drive a piezo print nozzle.

FIG. 2 illustrates examples of an amplifier circuit 200 to drive a piezo print nozzle. The amplifier circuit 200 includes a differential amplifier 210 that receives a differential print command signal 220. Side legs shown at 230 provide gate voltages in the differential amplifier 210, wherein as the voltage differential of the print command signal 220 changes, the gate voltages provided by the side legs change and hence alter currents generated by the differential amplifier 210. Output from the differential amplifier 210 includes bias current and variable current that is generated as a result of the side legs 230 changing. The output of the differential amplifier 210 is fed to a current mirror 240 which generates output signals NEGOUT and POSOUT that can be employed by subsequent stages to drive a print nozzle.

Various switching components within the differential amplifier 210, side legs 230, and current mirror 240 work in concert to provide the bias adjuster function described above with respect to FIG. 1. Such switching components will be described below with respect to the discussion of FIG. 4.

Figure 3:
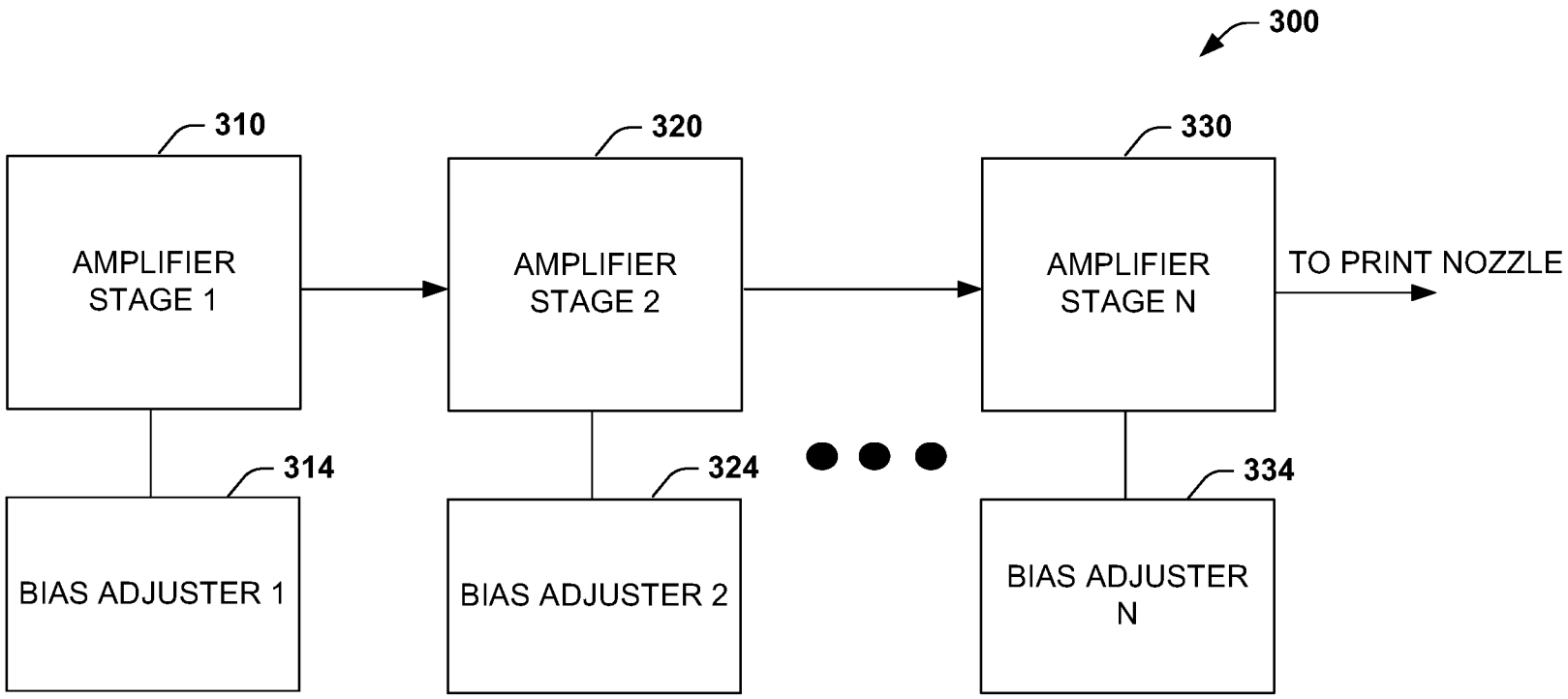
FIG. 3 illustrates an example multistage amplifier configuration that employs a bias adjuster to mitigate power and improve switching performance in circuits that drive a print nozzle.

FIG. 3 illustrates an example multistage amplifier configuration 300 that employs a bias adjuster to mitigate power and improve switching performance in circuits that drive a print nozzle. As shown, the multistage amplifier 300 can include a first amplifier stage 310 having a bias adjuster 314, a second amplifier stage 320 having a bias adjuster 324, followed by an Nth amplifier stage 330 having a bias adjuster 334, wherein N represents a positive integer. In one example configuration of the multistage amplifier 300, a two-stage amplifier can be employed to drive a print nozzle. For example, a first stage can be configured as a class AB amplifier and a second stage can be configured as a class B amplifier. Each stage however can be configured as class A, class B, or class AB. Also, each stage of the multistage amplifier 300 may or may not employ a bias adjuster. For example, a first stage may employ a bias adjuster and all subsequent stages do not. Various combinations of amplifier classes, classes utilizing bias adjusters, and classes without bias adjusters can be employed.

Figure 4:
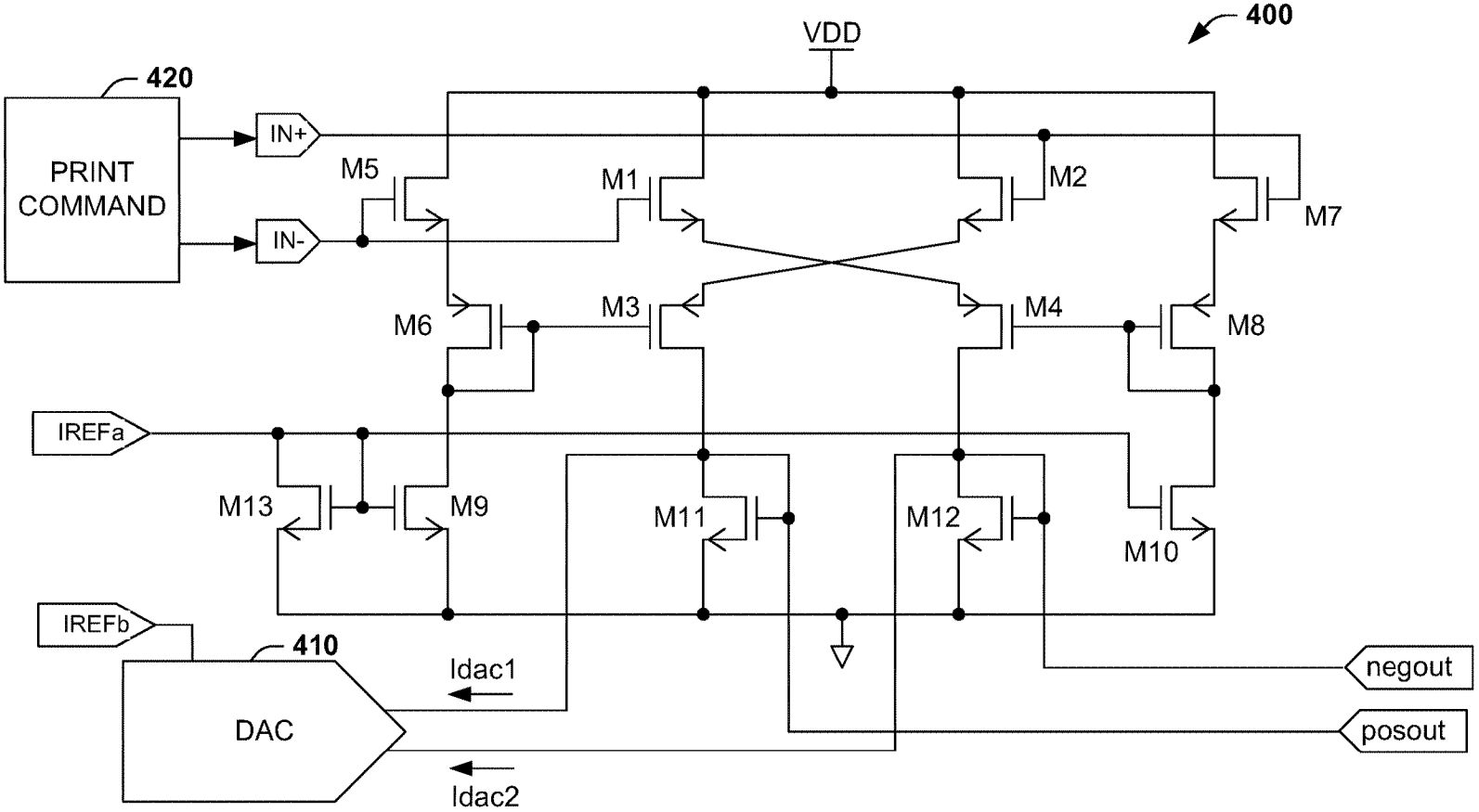
FIG. 4 illustrates an example amplifier circuit that employs a bias adjuster to mitigate power and improve switching performance in circuits that drive a print nozzle.

FIG. 4 illustrates an example amplifier circuit 400 that employs a bias adjuster to mitigate power and improve switching performance in circuits that drive a print nozzle. The circuit 400 can operate in class AB amplifier mode and can be employed to drive a subsequent amplifier stage that in one example operates in class B mode. The circuit 400 typically operates as a first stage. For purposes of discussion only, assume currents Idac1 and Idac2 into the DAC 410 are initially set to zero. For further simplicity of discussion, assume that the NMOS transistors M1, M2, M5, M7, and M9-M13 are about the same physical dimensions and properties, and assume the same for the associated PMOS transistors, M3, M4, M6, and M8. A print command signal 420 is received by inputs marked as IN+ and IN− which are amplified by transistors M1, M2, M3, and M4, configured as a differential amplifier.

Transistors M1-5 and M7 can be configured as source followers, wherein M5 receives input IN− and M7 receives input IN+. Output voltage from the source follower M5 and M7 sets the source voltage of M6 and M8, respectively. The gate voltage of M6 and M8 can be set by the source voltage of M5 and M7 plus the diode connected voltages of M6 and M8. Transistor pairs M6, M3 and M8, M4 can be designed to be current mirrors and mirror quiescent current into M11 and M12, respectively. The current in the two side legs of the circuit, one side-leg circuit being formed of M9, M6, M5 and the other side-leg circuit being formed of M10, M8 and M7 are set by current mirror into M9 and M10, and hence are substantially constant. One purpose of these side legs is to set the gate voltages for M3 and M4, where if the effective voltage difference between IN+ and IN− is equal to zero, and the common mode voltage within normal operating range, then the current in the transistors M11 and M12 can be equal to each other. If the effective voltage difference between IN+ and IN− is greater than or less than zero, then there can be a corresponding increase in current in the M11 or M12 legs respectively, with a current magnitude that can increase to a value greater than the original quiescent value in M11 and M12.

Since the additional current in M11 and M12 can be provided by the source follower action of M1 and M2 versus M3 and M4, it can reach a large magnitude, substantially determined by the source impedances and allowable voltage ranges provided by these devices and generally not limited by the original quiescent current. In this manner, this first stage amplifier depicted by the circuit 400 provides class A-B operation, where there is a substantially constant base bias current when the effective voltage difference between IN+ and IN− is equal to zero, and then when an effective voltage difference between the IN+ and IN− inputs is introduced, such as when the circuit 400 is being commanded to slew, the inner leg of the circuit that is needed to effect the slew has a current on it that grows to a large value, greater than that of the initial, constant bias. The transistors M9, M10, and M13 also receive and process a reference current shown as IREFa to set the original quiescent current.

Transistors M11 and M12 form a second current mirror that receives positive and negative output current from the differential amplifier at the drain leads of M3 and M4, respectively. The positive and negative output current fed to the current mirror formed from M11 and M12 include a bias current component and a variable current component that is a function of the voltage applied at IN+ and IN−. It is the bias current component that is fed to the current mirror of M11 and M12 that is offset by the current reduction DAC 410. As shown, the DAC 410 diverts bias currents Idac1 and Idac2, wherein the amount of current diverted is a function of the programmed value of the DAC that can be set from firmware settings via a controller (not shown) for example. A second reference, IREFb, can be supplied to the DAC 410.

Output from the amplifier 400 can be generated as negative and positive output signals and shown as signals negout and posout, respectively. In one example, negout and posout signals can be coupled to the gate of an NMOS transistor to form the second half of a mirror circuit in order to mirror the current output of this first stage into subsequent stages. Such output from the amplifier 400 can be employed to drive a subsequent amplifier stage (e.g., class B amplifier), wherein the subsequent stage is employed to control a level shifted stage that drives a piezo print nozzle amplifier, for example. As described above with respect to FIG. 3, a plurality of amplifier stages can be employed where all or a subset of the stages can employ the bias adjuster methods described herein. It is also possible to use alternate biasing methods with this first stage amplifier depicted as circuit 400, such as class-B, where there is substantially no bias current until slewing occurs. In this case, there may be undesirable effects from this lack of quiescent current, and the DAC 410 may be operated in a manner to supply a minimum quiescent current, similar to that described above, but in opposite polarity of operation.

As noted above, width and length die dimensions can be adjusted to mitigate power losses and enhance switching performance in the circuit 400. For example (w=width and l=length, u means micron or micro), M9, M10 can be selected as w=3.75 u by l=1 u to mirror in a small current, about 2.74 uA, about half of IREFa to keep the current used in the outer legs of the circuit 400 (M9, 11 legs) to a minimum. This current is static, and hence causes power dissipation. In another example, M1, M2, M5, M7, NMOS dimensions can be selected as w=40 um and l=1 u. For M3, M4, M6, M8, PMOS dimensions can be selected as w=80 u, l=1 u, for example. Such w/l ratios selected provide enough gain for the amplifier, yet also provide approximately a 1000× increase in bias current when slewing (for an ideal, matched set of transistors). In practice, the bias current increase for slew can be smaller due to transistor mismatch, wherein several hundreds of times the base bias current is realized. In yet another example, M11, M12, dimensions can be selected w=40 u, l=1 u, wherein these dimensions provide a low impedance, as these are mirrored not only to the second stage of the amplifier for level shifting but also mirrored to the level shifter for the pass gate (if implemented), so width here is controlled because of capacitive loading on this set of mirrors, for example.

Figure 5:
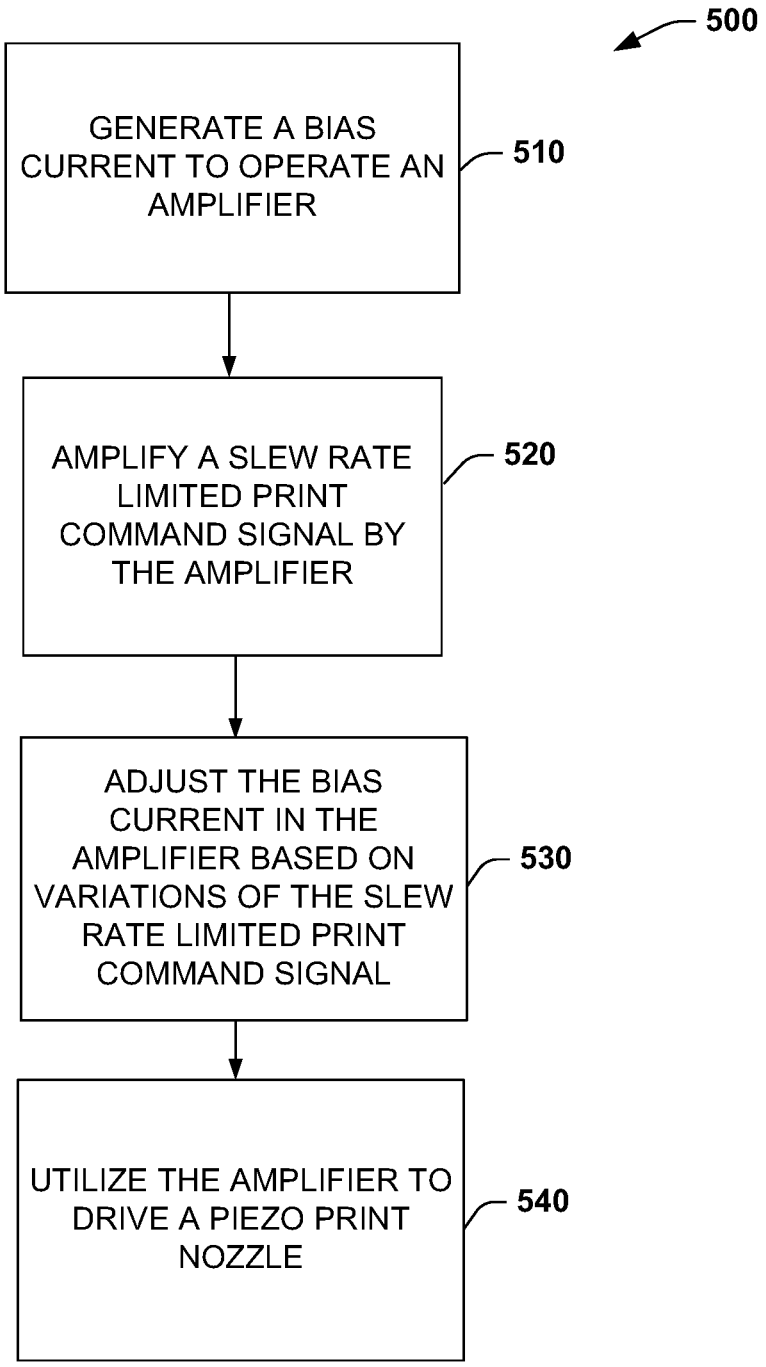
FIG. 5 illustrates an example method for mitigating power and improving switching performance in circuits that drive a print nozzle.

In view of the foregoing structural and functional features described above, an example method will be better appreciated with reference to FIG. 5. While, for purposes of simplicity of explanation, the method is shown and described as executing serially, it is to be understood and appreciated that the method is not limited by the illustrated order, as parts of the method could occur in different orders and/or concurrently from that shown and described herein.

FIG. 5 illustrates an example method 500 for mitigating power and enhancing switching performance in circuits that drive a print nozzle. The method 500 generates a bias current to operate an amplifier. Such bias current can be employed for normal quiescent operations of the amplifier which can be configured as a class AB operational amplifier for example. At 520, the method 500 amplifies a slew rate limited print command signal by the amplifier. At 530, the method 500 adjusts the bias current in the amplifier based on variations of the slew rate limited print command signal. At 540, the method 500 utilizes the amplifier to drive a piezo print nozzle.

Figure 6:
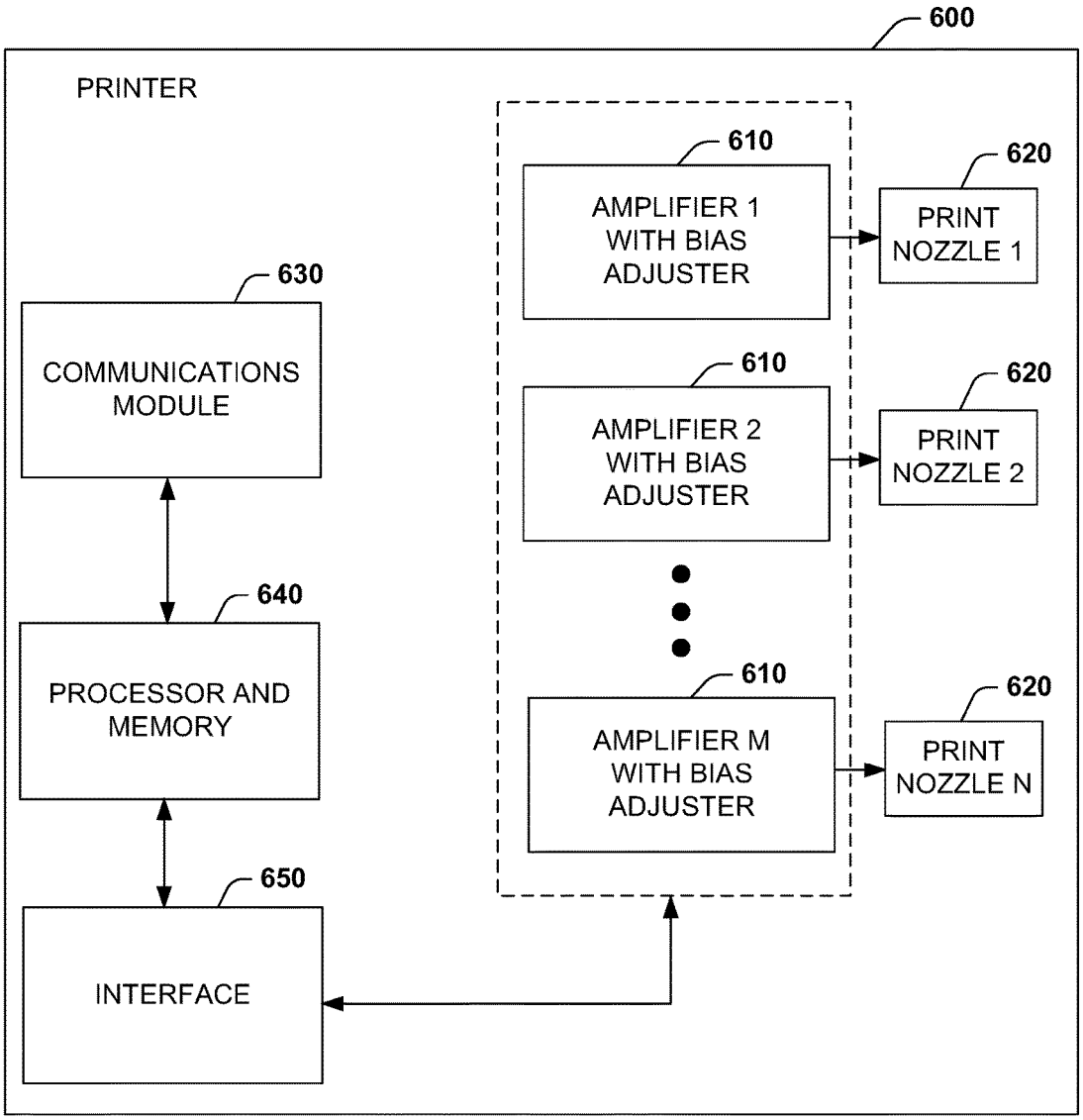
FIG. 6 illustrates an example printer that employs amplifiers utilizing bias adjusters to drive a plurality of print nozzles.

FIG. 6 illustrates an example printer 600 that employs amplifiers 610 utilizing bias adjusters to drive a plurality of print nozzles 620. The print nozzles 620 are shown as nozzles 1 through N, with N representing a positive integer. The respective print nozzles 620 are driven from a corresponding amplifier 610 shown as amplifiers 1 though M, with M representing a positive integer. Each of the respective amplifiers 610 can employ bias adjusters as previously described. The printer 600 can also include a communications module 630 for receiving print commands and updating printer status. The communications module 630 can include local connections such as from a print cable and/or can include remote network connections such as can be received from a local network and/or over a public network such as the Internet, for example. The communications module 630 can be operated by a processor and memory module 640 which can include executable operating instructions to operate the printer 600. Such instructions can operate the method 500 described above with respect to FIG. 5, for example, to generate drive waveforms at the print nozzles 620 and operations in the amplifiers 610. The processor and memory module 640 can also connect to an interface module 650 that performs digital to analog conversions among other interface operations to control the amplifiers 610.

What have been described above are examples. It is, of course, not possible to describe every conceivable combination of components or methodologies, but one of ordinary skill in the art will recognize that many further combinations and permutations are possible. Accordingly, the disclosure is intended to embrace all such alterations, modifications, and variations that fall within the scope of this application, including the appended claims. As used herein, the term "includes" means includes but not limited to, the term "including" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

What is claimed is:

1. An apparatus, comprising:

an amplifier to drive a piezo print nozzle in response to a bias current; and a bias adjuster comprising:

a plurality of side legs; and a plurality of current mirrors, wherein the bias adjuster is to vary the bias current in the amplifier based on a variable slew rate associated with an input signal of a print command, the bias adjuster to mitigate power loss and increase slew rate performance of the amplifier.

2. The apparatus of claim 1, wherein each side leg of the plurality of side legs includes bias components that are fabricated with a width of about 3.75 microns and a length of about 1 micron.

3. The apparatus of claim 1, wherein the input signal is one of a positive bias current and a negative bias current, such that the positive bias current drives the piezo print nozzle in a first direction and the negative bias current drives the piezo print nozzle in a second direction.

4. The apparatus of claim 3, wherein a first side leg of the plurality of side legs is to provide the positive bias current.

5. The apparatus of claim 3, wherein a second side leg of the plurality of side legs is to provide the negative bias current.

6. The apparatus of claim 1, wherein the plurality of current mirrors includes a given current mirror and another current mirror.

7. The apparatus of claim 6, wherein the bias current from the given current mirror is provided to the other current mirror to provide an output current to drive the print nozzle.

8. The apparatus of claim 6, further comprising a digital to analog converter to divert a predetermined amount of the bias current at the other current mirror.

9. The apparatus of claim 6, wherein the given current mirror includes a first pair of switch components that are fabricated with a width of about 40 microns and a length of about 1 micron.

10. The apparatus of claim 9, wherein the given current mirror includes a second pair of switch components that are fabricated with a width of about 80 microns and a length of about 1 micron.

11. A printer, comprising:

a plurality of piezo print nozzles;

a plurality of operational amplifiers to drive the piezo print nozzles, wherein each of the plurality of operational amplifiers is an amplifier to drive a piezo print nozzle in response to a bias current, and wherein each amplifier of plurality of operational amplifiers includes a bias adjuster comprising:

a plurality of side legs; and a plurality of current mirrors, wherein the bias adjuster is to vary the bias current in the amplifier based on a variable slew rate associated with an input signal of a print command, the bias adjuster to mitigate power loss and increase slew rate performance of the amplifier.

12. The printer of claim 11, wherein each amplifier further comprises a digital to analog converter to divert a predetermined amount of the bias current at a current mirror of the plurality of current mirrors.

13. The printer of claim 12, wherein the predetermined amount of the bias current is based on a reference current that is applied to the digital to analog converter.

14. The printer of claim 11, wherein a side leg of the plurality of side legs provides a quiescent current based on a reference current, the bias current being applied to the quiescent current to provide an output to drive a print nozzle of the plurality of print nozzles.

15. An apparatus, comprising:

an amplifier to drive a piezo print nozzle in response to a bias current; and a bias adjuster comprising:

a plurality of side legs to provide gate voltages in the amplifier, wherein the gate voltages change in response to a change in a voltage generated from a print command;

a plurality of current mirrors comprising:

a given current mirror, the given current mirror to generate an output based on the bias current and a variable current; and another current mirror to generate a plurality of drive output signals to drive a print nozzle based on the output of the given current mirror, wherein the plurality of drive output signals are one of a negative drive output signal and a positive drive output signal, the negative drive output signal to drive the print nozzle in a first direction and the positive drive output signal to drive the print nozzle in a second direction; and a digital to analog converter to divert a predetermined amount of current from the output at the other current mirror.

* * * * *